US011000723B2

(12) United States Patent
Borés Cifo

(10) Patent No.: US 11,000,723 B2
(45) Date of Patent: May 11, 2021

(54) INSTEP WEIGHTING TRAINING ACCESSORY

(71) Applicant: POWERINSTEP, S.L., Barcelona (ES)

(72) Inventor: Vicente Borés Cifo, Barcelona (ES)

(73) Assignee: POWERINSTEP, S.L., Barcelona (ES)

( * ) Notice: Subject to any disclaimer, the term of this patent is extended or adjusted under 35 U.S.C. 154(b) by 0 days.

(21) Appl. No.: 15/976,042

(22) Filed: May 10, 2018

(65) Prior Publication Data

US 2018/0326246 A1 Nov. 15, 2018

(30) Foreign Application Priority Data

May 10, 2017 (EP) ..... 17382263

(51) Int. Cl.
*A63B 21/065* (2006.01)
*A43B 5/00* (2006.01)
(Continued)

(52) U.S. Cl.
CPC ..... *A63B 21/065* (2013.01); *A43B 3/00* (2013.01); *A43B 5/00* (2013.01); *A43B 5/18* (2013.01); *A63B 21/4015* (2015.10); *A63B 23/03541* (2013.01); *A63B 23/04* (2013.01); *A43B 5/02* (2013.01); *A63B 41/00* (2013.01);
(Continued)

(58) Field of Classification Search
CPC .... A43B 3/00; A43B 5/00; A43B 5/02; A43B 5/18; A63B 21/065; A63B 21/4015; A63B 23/03541; A63B 23/04; A63B 41/00; A63B 43/002; A63B 69/002; A63B 2225/62; A63B 2243/0025; A63B 2243/0066; A63B 2243/007
See application file for complete search history.

(56) References Cited

U.S. PATENT DOCUMENTS 3,114,982 A 12/1963 McGowan
3,334,898 A 8/1967 McCrory et al.
(Continued)

FOREIGN PATENT DOCUMENTS

CN 2772550 Y 4/2006
EP 2055234 A1 5/2009
(Continued)

OTHER PUBLICATIONS

Spanish version of the International Search Report and Written Opinion for PCT application No. PCT/ES2014/070181 issued by the Spanish Patent and Trademark Office dated Apr. 15, 2014, 8 pages, Madrid Spain.
(Continued)

*Primary Examiner* — Joshua Lee
(74) *Attorney, Agent, or Firm* — Peter B. Scull; HDC IP Law LLP

(57) ABSTRACT

An instep weighting training accessory to be releasably fastened around the instep of a shoe having studs or cleats on its sole is provided. The accessory includes a strip, a weight and a layer of padding material. The strip includes an inner layer intended to be in contact the shoe and a sheath to be arranged on the instep of the shoe. The weight is enclosed inside the sheath and the padding material is located between the weight and the inner layer of the strip. In an alternative, an instep weighting training set having a plurality of training accessories is provided.

18 Claims, 8 Drawing Sheets

(51) Int. Cl.

| | |
|---|---|
| ***A43B 5/18*** | (2006.01) |
| ***A43B 3/00*** | (2006.01) |
| ***A63B 21/00*** | (2006.01) |
| ***A63B 23/035*** | (2006.01) |
| ***A63B 23/04*** | (2006.01) |
| *A43B 5/02* | (2006.01) |
| *A63B 41/00* | (2006.01) |
| *A63B 43/00* | (2006.01) |
| *A63B 69/00* | (2006.01) |

(52) U.S. Cl.

CPC ..... *A63B 43/002* (2013.01); *A63B 69/002* (2013.01); *A63B 2225/62* (2013.01); *A63B 2243/007* (2013.01); *A63B 2243/0025* (2013.01); *A63B 2243/0066* (2013.01)

(56) References Cited

U.S. PATENT DOCUMENTS

| | | | | |
|---|---|---|---|---|
| 4,231,170 | A | 11/1980 | Griswold | |
| 4,247,097 | A | 1/1981 | Schwartz | |
| 4,258,914 | A | 3/1981 | Lalli | |
| 4,322,072 | A * | 3/1982 | White | A63B 21/065 482/105 |
| 4,355,801 | A * | 10/1982 | Thomsen | A63B 21/065 482/105 |
| 4,458,432 | A | 7/1984 | Stempski | |
| 4,507,882 | A | 4/1985 | Harrell | |
| 4,536,975 | A | 8/1985 | Harrell | |
| 4,556,215 | A | 12/1985 | Tarbox | |
| 4,575,075 | A | 3/1986 | Tarbox et al. | |
| 4,632,389 | A | 12/1986 | Moss | |
| 4,777,743 | A | 10/1988 | Roehrig, Jr. | |
| 4,823,426 | A | 4/1989 | Bragga | |
| 4,838,546 | A * | 6/1989 | Winston | A63B 21/065 482/105 |
| 5,127,891 | A * | 7/1992 | Winston | A63B 21/065 482/105 |
| 5,162,032 | A * | 11/1992 | Dohner | A43B 3/0031 482/105 |
| 5,265,353 | A | 11/1993 | Marega et al. | |
| 5,311,679 | A | 5/1994 | Birch, Sr. | |
| 5,459,947 | A | 10/1995 | Lasher | |
| 5,542,896 | A | 8/1996 | Qaiesi et al. | |
| 5,632,709 | A | 5/1997 | Walsh | |
| 5,683,335 | A | 11/1997 | Groves et al. | |
| 5,728,032 | A | 3/1998 | Glass | |
| 5,868,652 | A | 2/1999 | Spletzer | |
| 5,893,223 | A | 4/1999 | Glass | |
| 6,010,438 | A * | 1/2000 | Fitzgerald | A63B 21/065 36/132 |
| 6,039,677 | A | 3/2000 | Spletzer | |
| 6,357,147 | B1 | 3/2002 | Darley et al. | |
| 6,742,288 | B2 | 6/2004 | Choi | |
| 6,817,498 | B1 * | 11/2004 | Spratt | A43B 3/0031 224/191 |
| 7,000,337 | B2 | 2/2006 | Harrington | |
| 7,063,650 | B1 * | 6/2006 | Beausoleil | A63B 21/0605 482/105 |
| 7,152,286 | B2 | 12/2006 | Rooney et al. | |
| 7,497,035 | B2 | 3/2009 | Kos et al. | |
| 7,559,127 | B2 | 7/2009 | Rooney et al. | |
| 7,833,137 | B2 | 11/2010 | Gamuette | |
| 9,009,992 | B2 | 4/2015 | Baker et al. | |
| 10,542,791 | B2 * | 1/2020 | Cifo Garcia | A43B 3/0031 |
| 2003/0192198 | A1 | 10/2003 | Wright | |
| 2004/0035025 | A1 | 2/2004 | Choi | |
| 2005/0224672 | A1 | 10/2005 | Butt et al. | |
| 2005/0252042 | A1 | 11/2005 | Harrington | |
| 2007/0089322 | A1 | 4/2007 | Rooney et al. | |
| 2008/0248932 | A1 | 10/2008 | Geritano | |
| 2010/0050477 | A1 | 3/2010 | Zeek | |
| 2010/0192419 | A1 | 8/2010 | Jack | |
| 2010/0210428 | A1 | 8/2010 | Gamuette | |
| 2011/0009713 | A1 * | 1/2011 | Feinberg | A61B 5/02438 600/301 |
| 2012/0028766 | A1 | 2/2012 | Zeek | |
| 2012/0028767 | A1 | 2/2012 | Zeek | |
| 2013/0008058 | A1 | 1/2013 | Jasmine | |
| 2014/0148315 | A1 * | 5/2014 | Thompson | A63B 23/03541 482/105 |
| 2014/0200412 | A1 | 7/2014 | Martinez et al. | |
| 2015/0264997 | A1 | 9/2015 | Myles | |
| 2016/0029742 | A1 * | 2/2016 | Cifo Garcia | A63B 21/4025 36/132 |
| 2016/0345656 | A1 | 12/2016 | Ramirez, II | |
| 2016/0375334 | A1 * | 12/2016 | Ragen | A63B 69/002 473/429 |
| 2017/0106225 | A1 * | 4/2017 | Bores Cifo | A63B 23/10 |

FOREIGN PATENT DOCUMENTS

| | | | |
|---|---|---|---|
| ES | 269613 | U | 8/1983 |
| ES | 1046537 | U | 1/2001 |
| ES | 1079084 | U | 4/2013 |
| GB | 2139103 | A | 11/1984 |
| WO | WO2014140400 | A1 | 9/2014 |

OTHER PUBLICATIONS

English Translation of the International Search Report and Written Opinion for PCT application No. PCT/ES2014/070181 issued by the Spanish Patent and Trademark Office dated Apr. 15, 2014, 9 pages, Madrid Spain.

Extended European Search Report for Application No. EP15382511 issued by the European Patent Office, dated Mar. 30, 2016, 8 pages, Munich, Germany.

* cited by examiner

INSTEP WEIGHTING TRAINING ACCESSORY

The subject matter hereof relates to training accessories, more specifically to training accessories to be releasably fastened around the instep of a shoe having studs or cleats in such a way that a weight may be specifically located over the instep.

BACKGROUND

The use of weighting devices during training sessions of sportspeople e.g. runners, football players, etc. is known. Some of the used devices are designed to be placed on the instep.

However, the shoes used in some sports e.g. football or athletics, include special features such as studs, cleats or spikes on their sole, very thin shoe laces and/or very thin shoe tongues to which known weighting devices may not be properly fixed or adapted.

Moreover, in some sports e.g. football, wherein a ball is shot, the instep of the shoe may be used as ball-kicking area and known instep weighting devices e.g. due to the shape, size, etc., may interfere in the shot quality, may cause discomfort when playing the ball or pain when kicking the ball or may even become unintentionally detached or broken as a consequence of the impact.

Removing known instep weighting devices for playing the ball, and/or for performing training sessions that alternate work series with weight and without weight to avoid muscle overcharge, may require repeatedly tying and untying the shoelaces.

In conclusion, it would be desirable to provide an instep-weighting device configured to be securely yet releasably fastened on shoes having studs, cleats or spikes and/or which does not hinder playing or shooting a ball.

SUMMARY

In a first aspect, an instep weighting training accessory to be releasably fastened around the instep of a shoe having studs or cleats on its sole is provided. The accessory may include a strip, a weight and a layer of padding material. The strip may further include an inner layer intended to be in contact the shoe and a sheath to be arranged on the instep of the shoe. The weight may then be enclosed inside the sheath and the padding material located between the weight and the inner layer of the strip.

Using a weighting training accessory enables improvement of performance by increasing sportsman/sportswoman strength and technique. By having the weight snugly enclosed inside a sheath, such that it cannot move therein, uncomfortable movements of the weight i.e. as consequence of the training, are avoided and moreover, the weight cannot become unintentionally detached as a consequence of an impact e.g. when the ball is shot.

A training session of a ball sport, for example football, may be realized with instep weights, by using the training accessory as disclosed herein. Contrary to prior instep weighting devices, which cannot be used for sports in which a ball is kicked, the accessories disclosed herein do not cause discomfort to the user when the ball impacts on the insole, by virtue of the padding. A suitable shape of the weight may also prevent any effect of the training accessory on the trajectory of the ball.

By arranging the training accessory around the instep of a shoe (with the weight placed on the instep itself) any discomfort may be avoided, as part of the strip will be located in correspondence with the arch zone of the shoe and therefore it would not hinder or alter the movements of the user, e.g. when running or walking. Furthermore, a cleated shoe may include studs or cleats on the whole sole except in the arch zone. Therefore the strip may be placed in a recessed area of the sole, which enhances the grip. In fact, the studs or cleats of the shoe block the strip movement if the strip is slightly moved as consequence of the training movements, e.g. when the ball is shot.

In an example, the training accessory may include a fastening system for releasably fastening the training accessory around the instep of a shoe. By being able to fasten/unfasten the training accessory, the user may alternate training sessions with and without weight to avoid muscle overcharge. The change in the working series may be done in a very quick and simple way by fitting and removing the training devices on the shoes, without requiring for example tying and untying the shoelaces repeatedly.

In an example, a width of the strip may vary along the length of the strip to be better adapted to each user foot characteristics.

In a second aspect, an instep weighting training set including a plurality of training accessories is provided.

BRIEF DESCRIPTION OF THE DRAWINGS

Non-limiting examples of the present disclosure will be described in the following, with reference to the appended drawings, in which.

DETAILED DESCRIPTION

Figure 1:
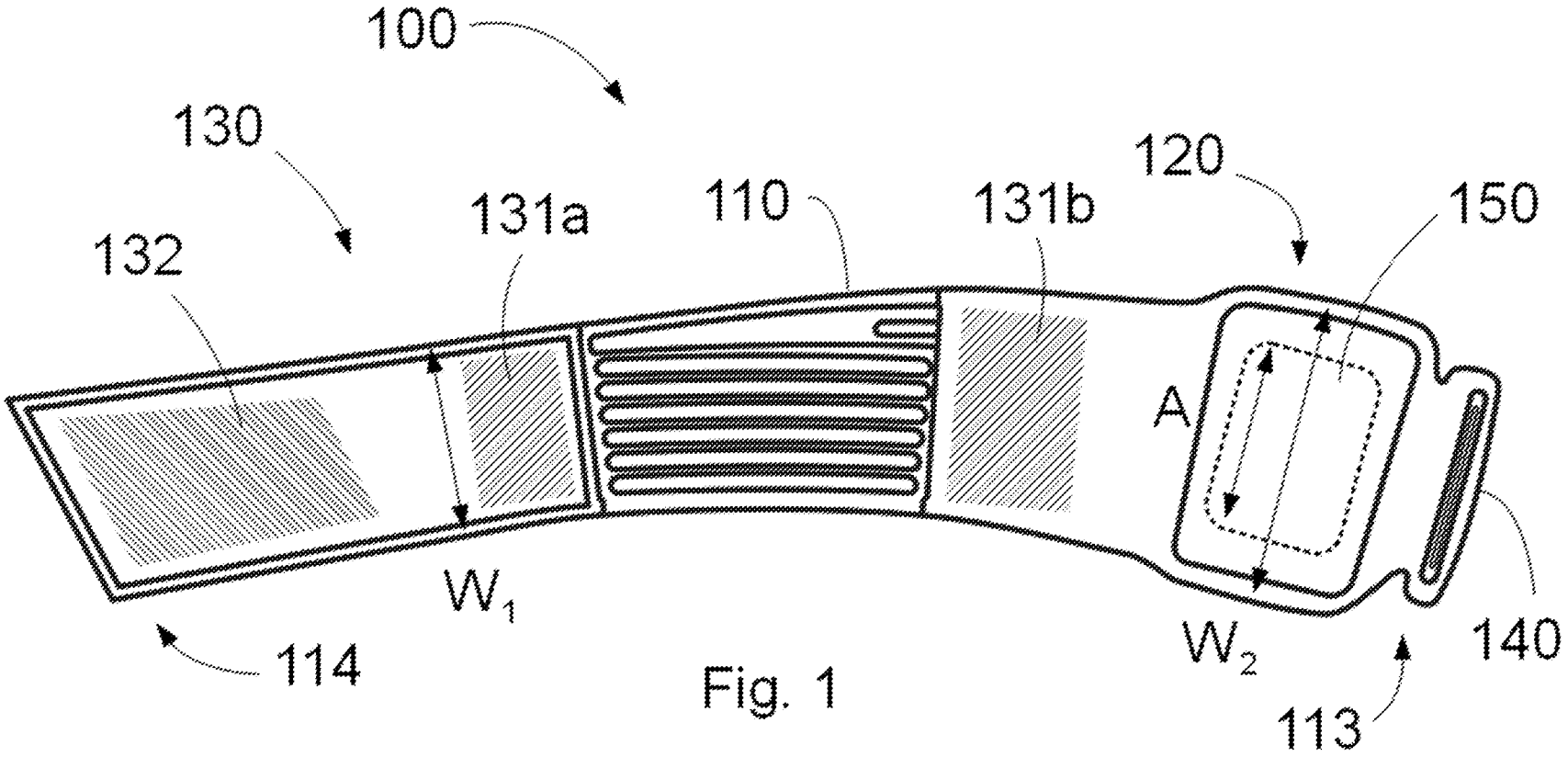
FIG. 1 schematically illustrates a top view of a training accessory according to an example.
Figure 2:
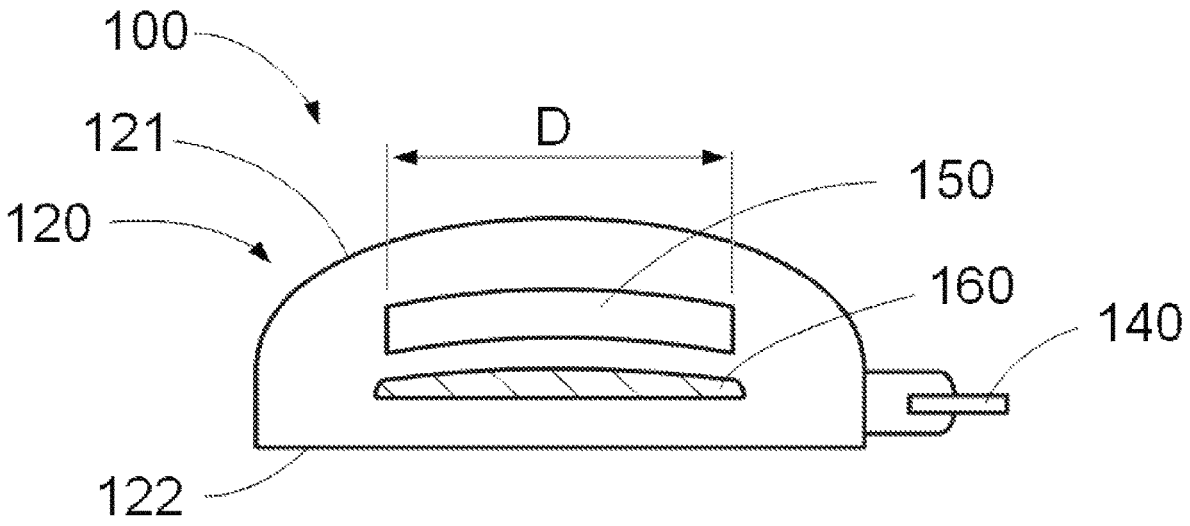
FIG. 2 illustrates in a very schematic way the structure of a portion of a training accessory according to an example, in cross-sectional view.

FIGS. 1 and 2 show a top view and a cross section of an example of an instep weighting training accessory 100, i.e. a training accessory or device intended to place a weight on the instep of the foot during training (from now on "training accessory"). The training accessory 100 may include a strip 110 to be releasably fastened around the instep of a shoe, e.g. a shoe having studs, cleats or spikes on its sole. The strip 110 may be made of a flexible and/or elastic material, for example of polyvinyl chloride (PVC), to facilitate its fastening around the instep of the shoe. Note, for example, the training accessory may be manufactured in different sizes e.g., in some cases, in three different sizes such as small, medium and large.

The strip 110 may be made of a plurality of layers, at least in part of its length. In an example, the strip 110 may at least include an inner layer to be in contact with the instep of the shoe and an outer layer.

The strip 110 may be a continuous band which may include a first end 113 and a second end 114. The first end 113 may include a sheath 120 (described further below) while the second end 114 may be cut at an angle i.e. thereby forming a protruding portion which may be used to pull and detach the strip 110. In an example, the second end may include a tab to facilitate unfastening the strip 110.

In some examples, the width W of the strip 110 may vary along its length e.g. to be better adapted to a shoe including studs, cleats or spikes on its sole. In an example, the strip portion $W_1$ to be placed below the arch of the shoe may be narrower than the portion $W_2$ to be placed on the instep of a shoe. By varying the strip width a more comfortable fitting may be obtained. In an example, an end of the strip e.g. the end without the sheath, may be narrower than the other end. In an example, the width W may be gradually decreased from one end of the strip to the other.

The training accessory 100 of FIG. 1 may further include sheath 120 in which a weight 150 may be housed. The sheath 120 may be placed at or near the widest end of the strip 110, e.g. on or near the first end 113 of the example of FIG. 1, and it may be formed by the overlap of layers, e.g. it may be formed by the inner and outer layers of the strip 110. In another example, the sheath 120 may be an independent housing which may be fixed to the strip 110 e.g. by an adhesive, by sewing it, or by any other suitable method.

The training accessory 100 may also include a fastening system 130 with at least two cooperating parts 131, 132, e.g. a hook-and-loop system, a magnetic system, etc. The fastening system 130 may enable a tight and secure fastening of the training accessory 100 to a shoe, and it may be releasable.

In some examples, the fastening element 132 may be fixed in a single fastening area, such as fastening portion 131*a* in FIG. 1, along which the fastening element 132 may be attached in several adjacent positions. This allows the strip 110 to be suitably tightened on shoes of e.g. different sizes, shapes and features. The fastening portion 131*a* may be provided on the part of the strip 110 intended to remain, in use, on one side of the shoe, such that the fastening of the strip is made mainly on the side and not on the sole of the shoe.

The fastening system 130 may also provide more than one fastening area, for example by providing two separate fastening portions 131*a*, 131*b* to selectively cooperate with a fastening element 132, as in the example of FIG. 1. The fastening element 132 may be fixed in two possible discrete fastening positions due to the two independent fastening portions 131*a*, 131*b*. The fastening portion 131*a* may define a first fastening position which may be used to fasten the training accessory 100 to the instep of a shoe. The fastening portion 131*b* may define a second fastening position in which the strip 110 may form a narrower loop than the first position. Such other fastening position may be used to fasten the training accessory 100 to a user wrist. Each fastening portion may be large enough to allow some adjustment when fastening the strip 110, as mentioned above.

In some examples, the strip 110 may also include a single continuous fastening area (not shown) along which the fastening element 132 may be fixed in any desired position. A continuous fastening portion may extend between a point at or near the end without a sheath and a point at or near the sheath.

FIG. 1 further depicts a guiding element 140 such as a buckle, to strengthen, guide and facilitate the fastening of the strip 110 around the instep. The guiding element 140 may be placed at or near the strip end having the sheath 120. Such guiding element 140 may be made of a substantially rigid material e.g. plastic.

To fasten the training accessory 100 to the instep of a shoe e.g. a shoe including studs, cleats or spikes on its sole, firstly, the strip portion including the sheath 120 may be placed substantially on the instep of the shoe, on top of the shoe. Secondly, the opposite end of the strip may be passed through the guiding element 140, pulled backwards to be tightened, and fixed at the desired position, by attaching the fastening element 132 on the corresponding fastening portion, usually fastening portion 131*a* for a shoe.

On the contrary, to release the training accessory 100, the fastening element 132 may be firstly detached from the fastening portion 131*a*, 131*b* e.g. by pulling the tab and/or the protruding portion. The strip 110 may be in part or completely removed from the guiding element and finally the training accessory may be removed from the shoe.

FIG. 2 shows a cross-section of the sheath 120 of FIG. 1 formed by the overlap of an outer layer 121 and an inner layer 122. The sheath 120 may be formed with a curvature in the outer region. In an example, the sheath may also be provided with a slight curvature (not shown) in the inner region, i.e. to be adapted to the natural curvature of the instep. FIG. 2 is very schematic, intended solely for the purpose of showing the relative position of the different elements in the sheath 120, and is not drawn to scale.

The sheath 120 may house a weight 150 which may be snugly fitted within the sheath, i.e. to avoid uncomfortable movements of the weight while training. The weight 150 may be made of a dense metal e.g. lead, such that it may be thin and avoid obstructing user movements and/or the quality of the ball shots. The shape of the weight 150 may be the same regardless of the weight load e.g. 50 g, 100 g, 150 g, 200 g, etc. However, the thickness of a weight may vary depending on the weight load, i.e. heavier weights may be slightly thicker than lighter ones as a consequence of having more material. The thickness may also be the same for different weight loads, for example by using a different material or alloy for each.

Similarly to the sheath 120, the weight 150 may also include a slight inward curvature, at least on the side to be in contact with the instep of the shoe (see FIGS. 3*b* and 3*c*) i.e. to be more comfortably adapted on the instep of the shoe. In an example, the whole weight may have a shape including an outwardly protruding curvature (see FIGS. 3*b* and 3*c*). Such a curvature may be along the longitudinal and/or the transversal axis. In an example the weight 150 may have substantially trapezoidal shape with rounded vertices (see FIG. 3*a*). In an example, the average width D (see FIG. 2) of the weight 150 may be of about 48 mm and its length A (see FIG. 1) may be around 64 mm. In an example, the edges of the weight 150 may be substantially rounded and/or bevelled. In an example, the surface area of the weight 150 may be around 60 $cm^2$.

The sheath 120 may further include, as also visible in FIG. 2, a layer of padding material 160 which may be placed between the weight 150 and the inner layer 122 of the sheath to absorb any impact caused when the user is exercising. The padding material may be e.g. polyurethane (PU) foam, ethylene-vinyl acetate (EVA), poly(ethylene-vinyl acetate) (PEVA) or any other suitable material. The thickness of the layer of padding material 160 is sufficient to avoid any discomfort to the user by the pressure of the weight on the instep, and especially to dampen the impact when the user shoots the ball. The padding material 160 may be attached to the inner layer 122 of the sheath, for example by gluing or sewing. In some implementations it may be integral with the sheath 120, for example if the inner layer 122 is formed with a thickened section suitable for absorbing the impacts of the ball, while the rest of the strip 110 has a thinner section. The padding material 160 may also be snugly contained inside the sheath 120, together with the weight 150.

Figure 3A:
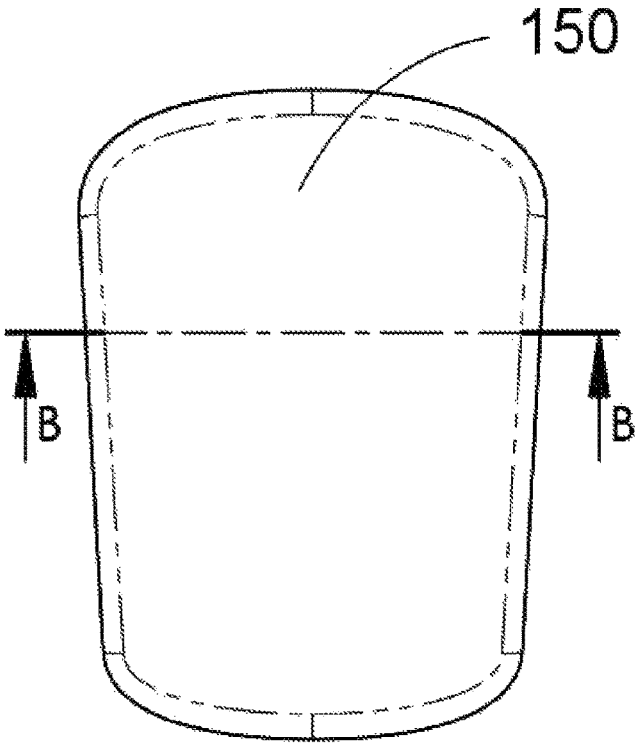
FIGS. 3*a*-3*c* schematically illustrate different views of a weight according to an example.
Figure 3B:
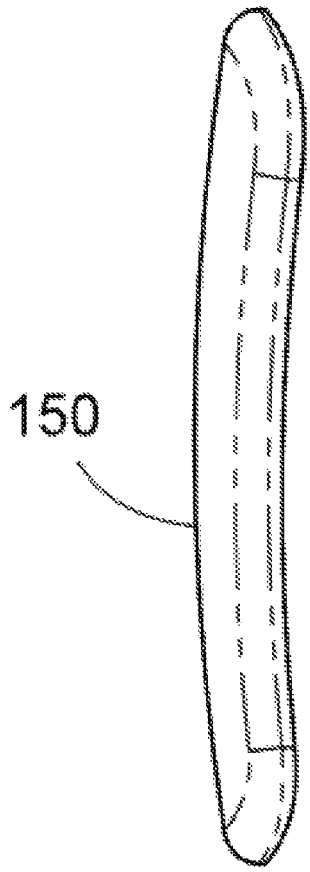
Figure 3C:
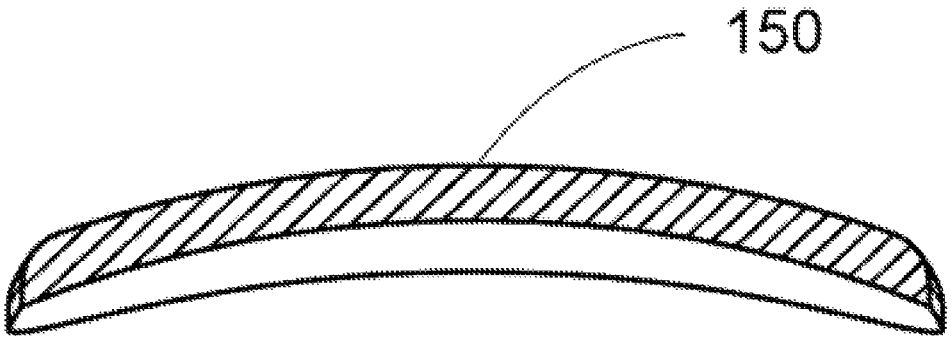

FIG. 3*a* shows a top view of an example of the weight 150 of FIGS. 1 and 2. FIG. 3*b* shows a lateral view of the weight 150 (i.e. seen from one side of FIG. 3*a*) and FIG. 3*c* depicts a cross-section of the weight 150 taken along the line B-B of FIG. 3*a*.

Figure 4:
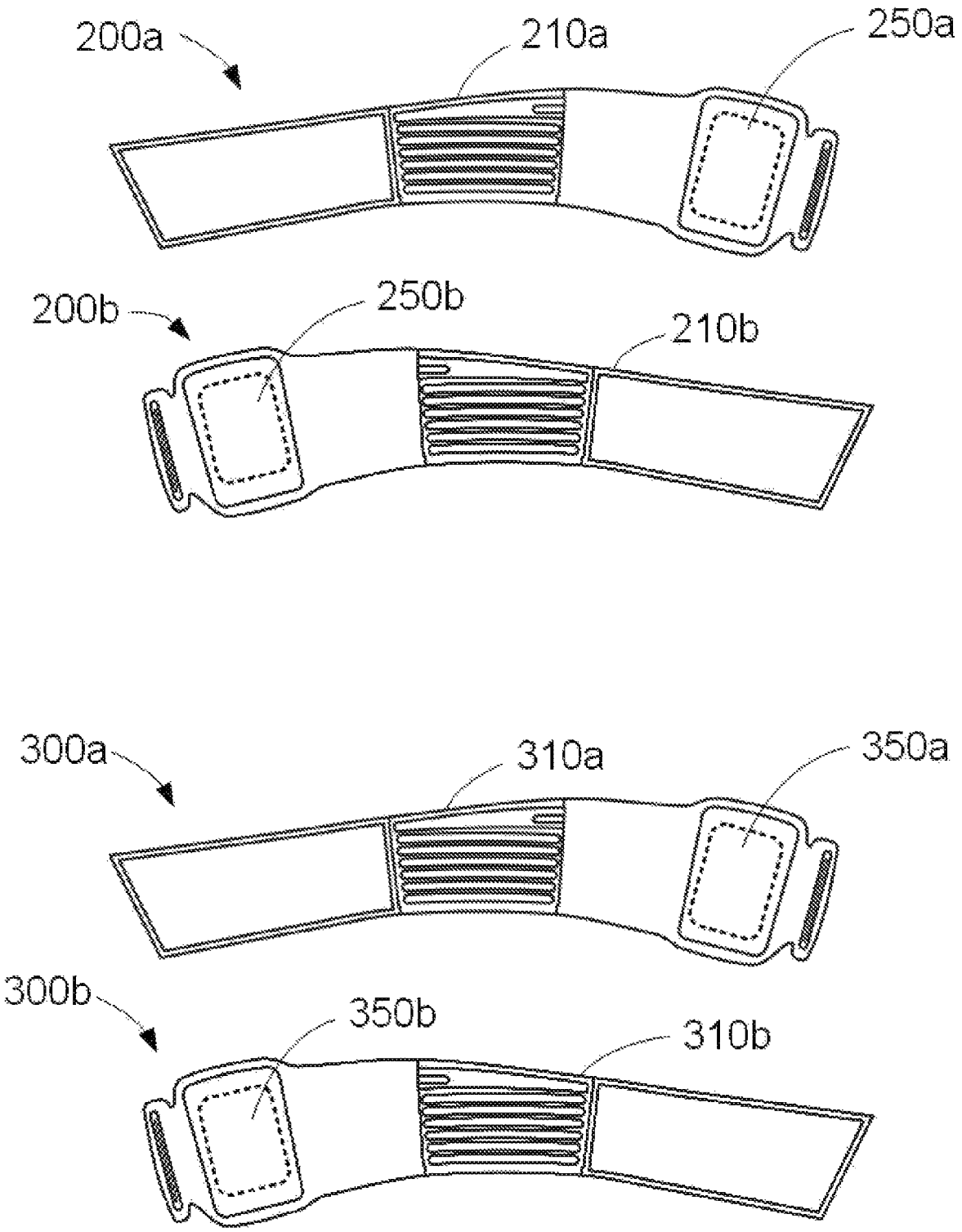
FIG. 4 schematically illustrates a training set according to an example.

Sets of training accessories of different weights may be foreseen. For example, FIG. 4 depicts a training set which may include pairs of training accessories, such as 200*a*, 200*b* and/or 300*a*, 300*b*. Each pair of training accessories may include weights, such as 250*a*, 250*b* and 350*a*, 350*b*, having a specific load, which differs from one pair to another. For example, a set of four pairs of accessories may be provided, with weights of e.g. 50 grams, 100 grams, 150 grams and 200 grams, respectively. For example, training accessories 200*a* and 200*b* of FIG. 4 may have weights 250*a*, 250*b* e.g. of 50 grams each, while training accessories 300*a*, 300*b* of FIG. 4 may have weights 350*a*, 350*b* e.g. of 200 grams each. In an example, the strips 210*a*, 210*b*, 310*a*, 310*b* of the training accessories forming a pair may be orientated in opposite directions i.e. to facilitate fastening each training accessory to one of the shoes of the user.

In use, a pair of training accessories may be simultaneously used, i.e. each training accessory forming a pair may be fastened to one of the shoes of the user, and both training accessories may include a weight of the same load. During a training session different training accessories or pairs including different load weights may be interchanged and/or alternated, e.g. the weight load may be gradually increased during a training session or from a training session to another.

In an exemplary training session, the user may firstly fasten a pair of training accessories having the same weight load to the instep of each shoe. The user may then perform alternated series with and without weight, and/or with different weights, e.g. by fastening and unfastening the training accessories to/from the instep of the shoe. The session may end for example with a series without weight. The series with the training accessories i.e. the series with weight, may be performed during a predetermined period of time which may depend e.g. on the total training time, on the kind of sport routine and/or user characteristics such as body weight, physical condition, etc.

A training method with the instep weighting training accessories disclosed may include the steps of: attaching instep weighting training accessories to the shoes in such a way that the weight thereof is placed on the instep; performing a number of exercises, including exercises that include shooting a ball; and removing the instep weighting training accessories from the shoes.

In an example, particularly since the training accessory may include a padding layer, the training sessions may include exercises using a ball e.g. a soccer ball, a football ball, a rugby ball, etc. The training session(s) including a ball may be focused on improving the technique and/or ability e.g. dribbling, ball carrying/driving, rondo drills, etc., and/or focused on ball kicking, shooting, etc.

Figure 5A:
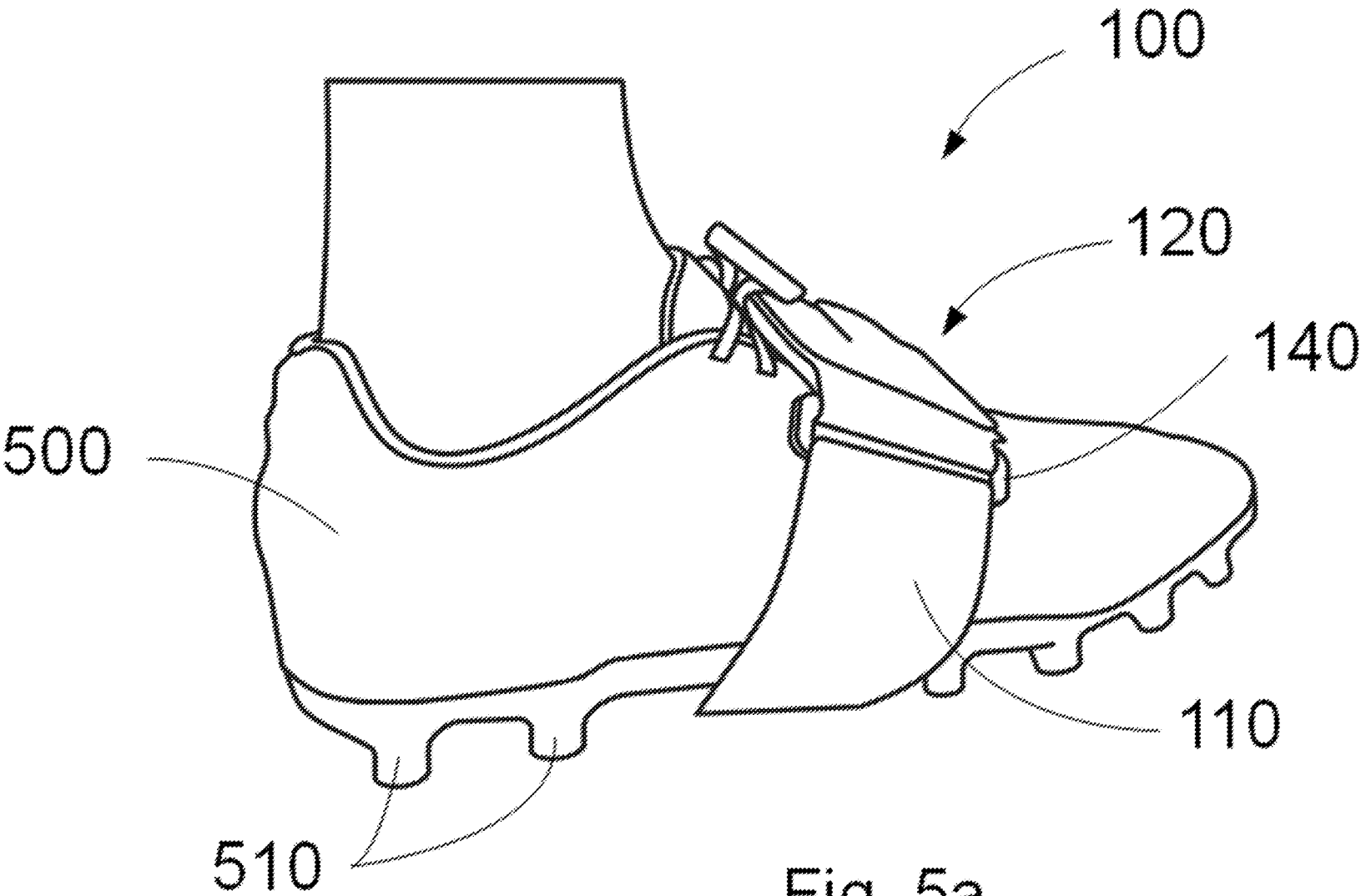
FIGS. 5*a*-5*c* schematically illustrate different views of a training accessory arranged on the instep of a shoe.
Figure 5B:
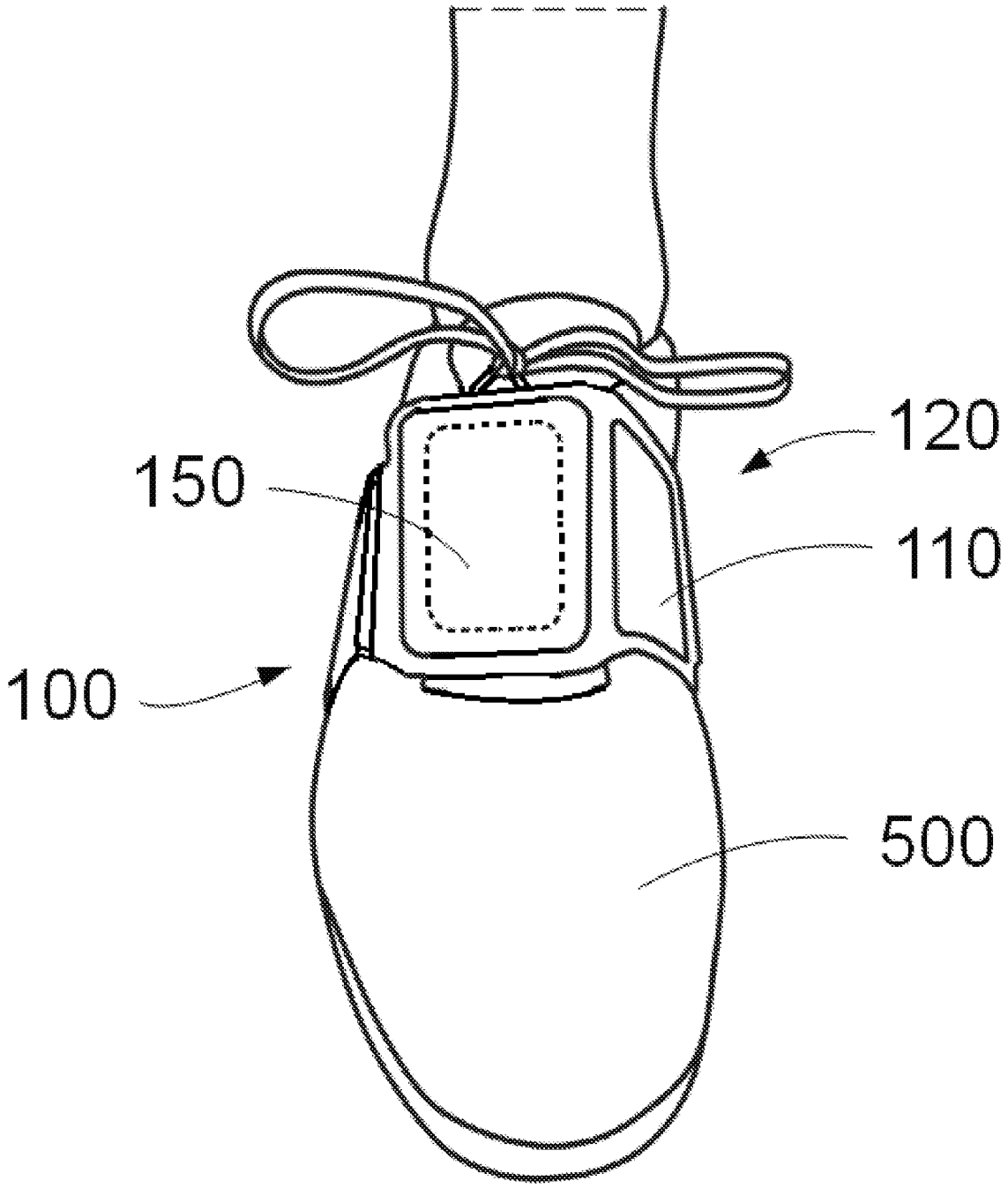
Figure 5C:
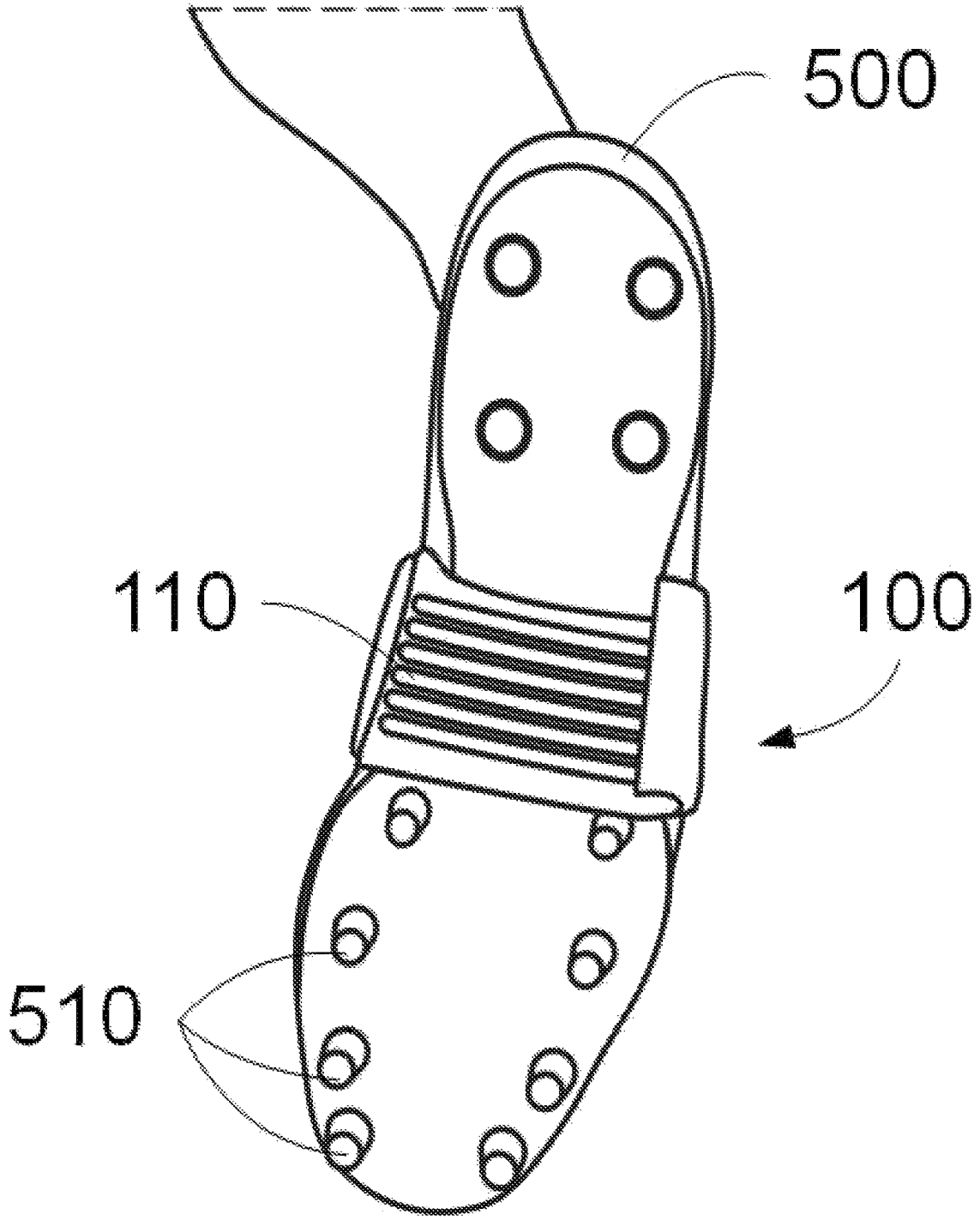

FIG. 5*a* shows a lateral view of a training accessory 100 fastened around a shoe 500 having studs or cleats 510. The sheath 120 may be placed as shown on the instep of the shoe 500 and by adjusting the strip 110 a secure fastening of the training accessory may be obtained. FIG. 5*b* shows a top view of the training accessory 100 wherein the sheath 120 including a weight 150 is placed as shown on the instep of the shoe 500. FIG. 5*c* depicts the sole of the shoe 500 having the strip 110 fastened around the shoe 500 in the arch of the shoe i.e. the zone without cleats or spikes.

Figure 6:
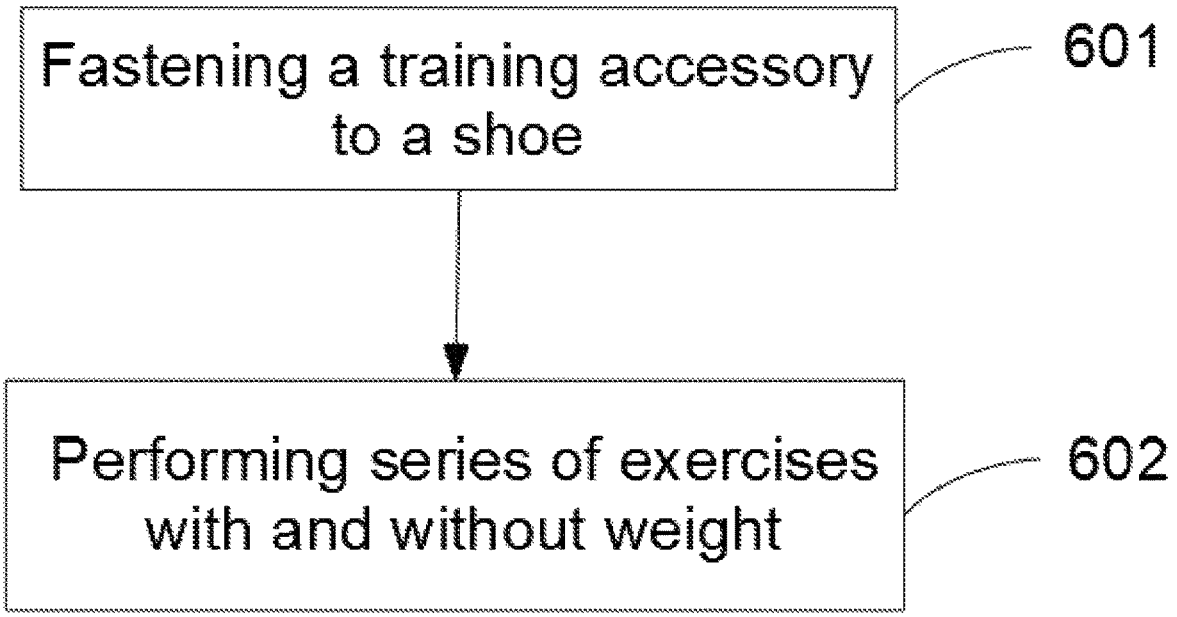
FIG. 6 illustrates a flow chart of a training method according to an example.

FIG. 6 shows a training method in which a training accessory according to any of the disclosed examples may be used. Firstly, in block 601, the user may fasten a training accessory according to any of the disclosed examples to one of his/her shoes. Then, in block 602, the user may perform an exercise with the accessory 100, which in some examples may include alternated series of exercises with and without weight during a predetermined period of time.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow. If reference signs related to drawings are placed in parentheses in a claim, they are solely for attempting to increase the intelligibility of the claim, and shall not be construed as limiting the scope of the claim.

The invention claimed is:

1. An instep weight training accessory to be releasably fastened around the instep of a shoe having studs or cleats on its sole, the instep of the shoe being defined by the top, sides and sole of the shoe in the arch zone of the shoe, the accessory comprising:

a singular strip configured to be releasably fastened in a singular loop around the instep of a shoe having studs or cleats on the sole of the shoe, and the strip being configured to be located in correspondence with the arch zone of the shoe and in a recessed area of the sole of the shoe:

the strip having sufficient length to be wrapped around the instep, including the sides and the arch of a shoe with studs or cleats;

the strip having sufficient length for fastening in a singular loop around the instep of a shoe:

the strip comprising:

an inner layer configured to be in contact with the shoe, a sheath to be arranged on the instep of the shoe, and a fastening system for releasably fastening the training accessory around the instep of a shoe;

a weight shaped for contacting a ball, and disposed in a shape of a rigid plate, curved in a transverse direction of the shoe and arranged to be disposed only on the instep, the weight being snugly enclosed inside the sheath, and a discrete layer of padding material not integrally formed with or as part of the strip but disposed between the weight and the inner layer of the strip.

2. The instep weight training accessory according to claim 1, the discrete layer of padding material being a discrete different material from the strip.

3. The instep weight training accessory according to claim 1, the fastening system comprising one or more of:

a guiding element;

a buckle; and, a hook-and-loop system.

4. The instep weight training accessory according to claim 1, the fastening system comprising a fastening element and a fastening portion.

5. The instep weight training accessory according to claim 4, the fastening system comprising at least two separated fastening portions.

6. The instep weight training accessory according to claim 4, the fastening portion being a continuous fastening portion.

7. The instep weight training accessory according to claim 1, a width of the strip varying along a length of the strip.

8. The instep weight training accessory according to claim 1, the weight being made of one or more of: a metal, a dense metal, and lead.

9. The instep weight training accessory according to claim 8, the weight being one or more of:

a singular rigid plate; and, concave in shape.

10. The instep weight training accessory according to claim 1, the padding material being foam.

11. An instep weight training set comprising a plurality of training accessories according to claim 1.

12. A training method comprising:

fastening a training accessory according to claim 1 to a shoe of a user; and performing an exercise.

13. The training method according to claim 12, further comprising performing an alternated series of exercises with and without weight, or with different weights, during predetermined periods of time.

14. The training method according to claim 12, further comprising using a pair of training accessories to be releasably fastened around the instep of a shoe having studs or cleats on its sole, each of the accessories comprising:

a strip comprising an inner layer intended to be in contact with the shoe, and a sheath connected to the inner layer to be arranged on the instep of the shoe, a weight enclosed inside the sheath, and a layer of padding material disposed between the weight and the inner layer of the strip.

15. The training method according to claim 14, the weight of both training accessories being identical.

16. The training method according to claim 14, the weight of the training accessories varying from a series with weight to another series with weight.

17. The training method according to claim 12, the method further comprising exercises using a ball selected from a soccer ball, a football or a rugby ball.

18. A shoe, comprising a sole and an instep, the instep of the shoe being defined by the top, sides and sole of the shoe in the arch zone of the shoe, and comprising studs or cleats on the sole except the arch zone of the shoe, the shoe being provided with an instep weighting training accessory configured to be releasably fastened around the instep, the instep weighting training accessory comprising:

a singular strip configured to be releasably fastened in a singular loop around the instep of the shoe, and the strip being configured to be located in correspondence with the arch zone of the shoe and in a recessed area of the sole;

the strip having sufficient length to be wrapped around the instep, including the sides and the arch of a shoe with studs or cleats;

the strip having sufficient length for fastening in a singular loop around the instep of a shoe:

the strip comprising an inner layer intended to be in contact with the shoe, a sheath to be arranged on the instep of the shoe, the sheath being attached to the strip, and a fastening system for releasably fastening the training accessory around the instep of a shoe;

a weight shaped for contacting a ball, and disposed in the shape of a rigid plate arranged to be disposed only on the instep, the weight being snugly enclosed inside the sheath, and a discrete layer of padding material not integrally formed with or as part of the strip but disposed between the weight and the inner layer of the strip.

* * * * *